US005909983A

United States Patent [19]

McGee, Jr.

[11] Patent Number: 5,909,983

[45] Date of Patent: Jun. 8, 1999

[54] EMERGENCY WATER RESERVOIR APPARATUS

[76] Inventor: Wallace M. McGee, Jr., 25582 Paseo La Vista, Laguna Niguel, Calif. 92677

[21] Appl. No.: 08/804,738

[22] Filed: Feb. 21, 1997

[51] Int. Cl.[6] ..... A62C 35/68

[52] U.S. Cl. ..... 405/54; 169/13; 169/14

[58] Field of Search ..... 405/52, 53, 54; 169/13, 14, 16; 237/310

[56] References Cited

U.S. PATENT DOCUMENTS

| | | | |
|---|---|---|---|
| 2,694,454 | 11/1954 | Eickmeyer | 169/13 |
| 3,179,181 | 4/1965 | Banzato | 169/16 |
| 3,977,474 | 8/1976 | Boegli | 169/14 |
| 4,234,044 | 11/1980 | Hollan et al. | 169/14 |
| 4,981,178 | 1/1991 | Bundy | 169/13 |
| 5,145,014 | 9/1992 | Eberhardt | 169/13 |
| 5,165,482 | 11/1992 | Smagac et al. | 169/13 |
| 5,174,383 | 12/1992 | Haugen et al. | 169/13 |
| 5,234,286 | 8/1993 | Wagner | 405/53 |
| 5,588,779 | 12/1996 | Merrett | 405/54 |

FOREIGN PATENT DOCUMENTS

| | | | |
|---|---|---|---|
| 2702963 | 9/1994 | France | 169/13 |

*Primary Examiner*—Tamara Graysay
*Assistant Examiner*—Frederick Lagman

[57] ABSTRACT

An emergency water reservoir apparatus for providing a ready water reserve for extinguishing fires at a location such as a residence includes a water storage tank having an interior reservoir in fluid communication with a water hydrant valve. A water intake conduit in fluid communication with an established water supply and the interior reservoir permits delivery of water into the water tank from the established water supply system. Included at the reservoir end of the water intake conduit is a water intake cut-off device and an anti-siphon valve device. A water pump pumps water from the interior reservoir to the water hydrant valve. An infusion pump device with an infusion reservoir member and an adjustable infusion dispensing device provides infusion chemicals into the water passing from the interior reservoir to the water hydrant valve. An electrical power generator is included to provide backup power to the water pump and the infusion pump device when the location's power supply is cut off. The water hydrant valve has a hose quick fitting device to allow water hoses to be quickly attached to it. The water hoses allow a user to direct water from the water hydrant valve to locations where it is needed.

1 Claim, 3 Drawing Sheets

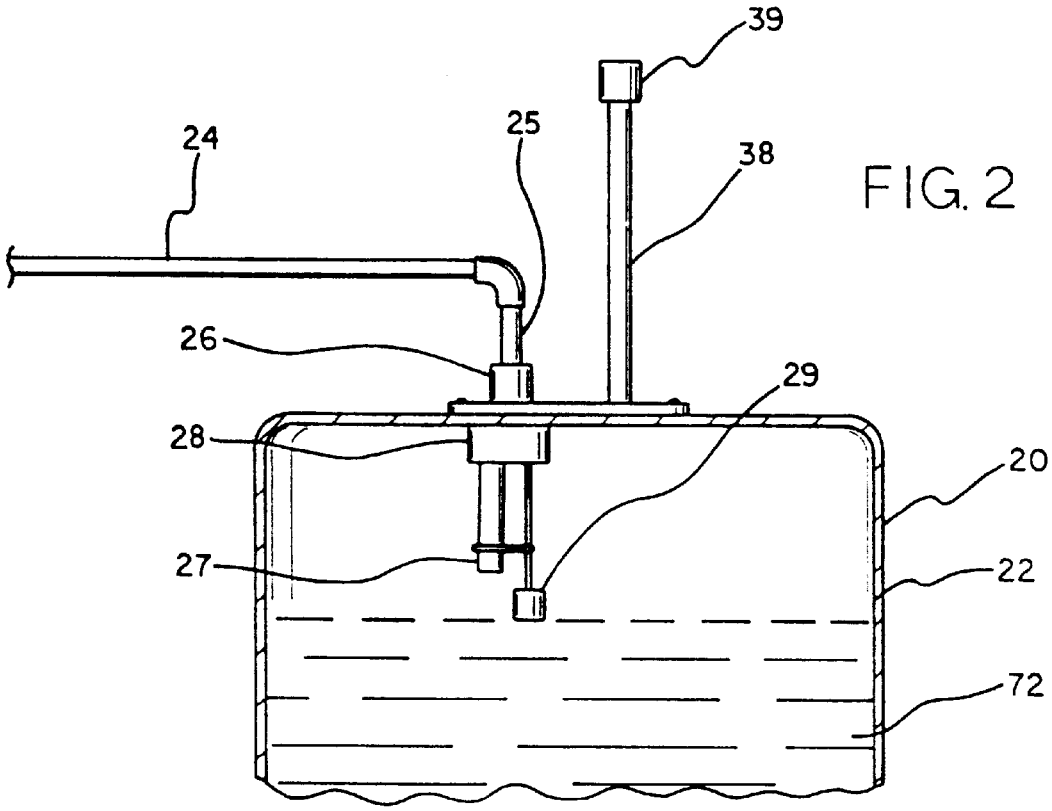
FIG. 2
FIG. 3
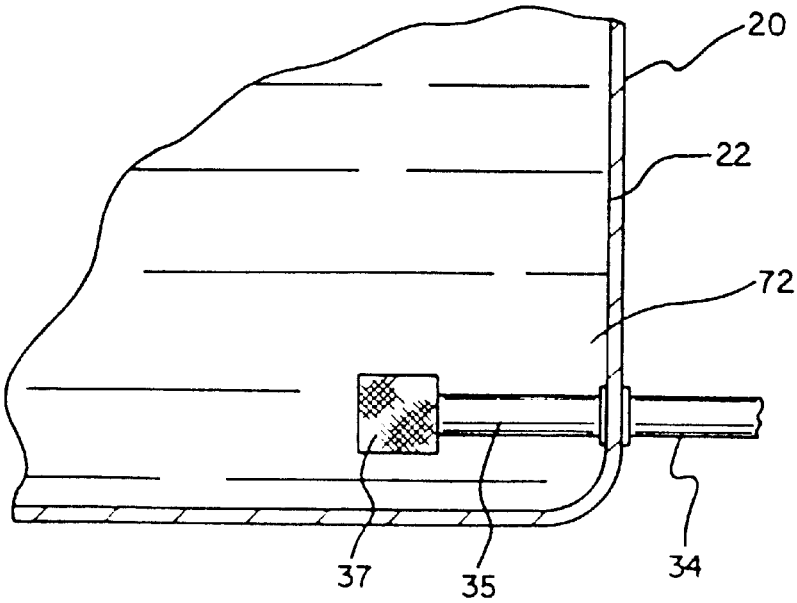

FIG. 4
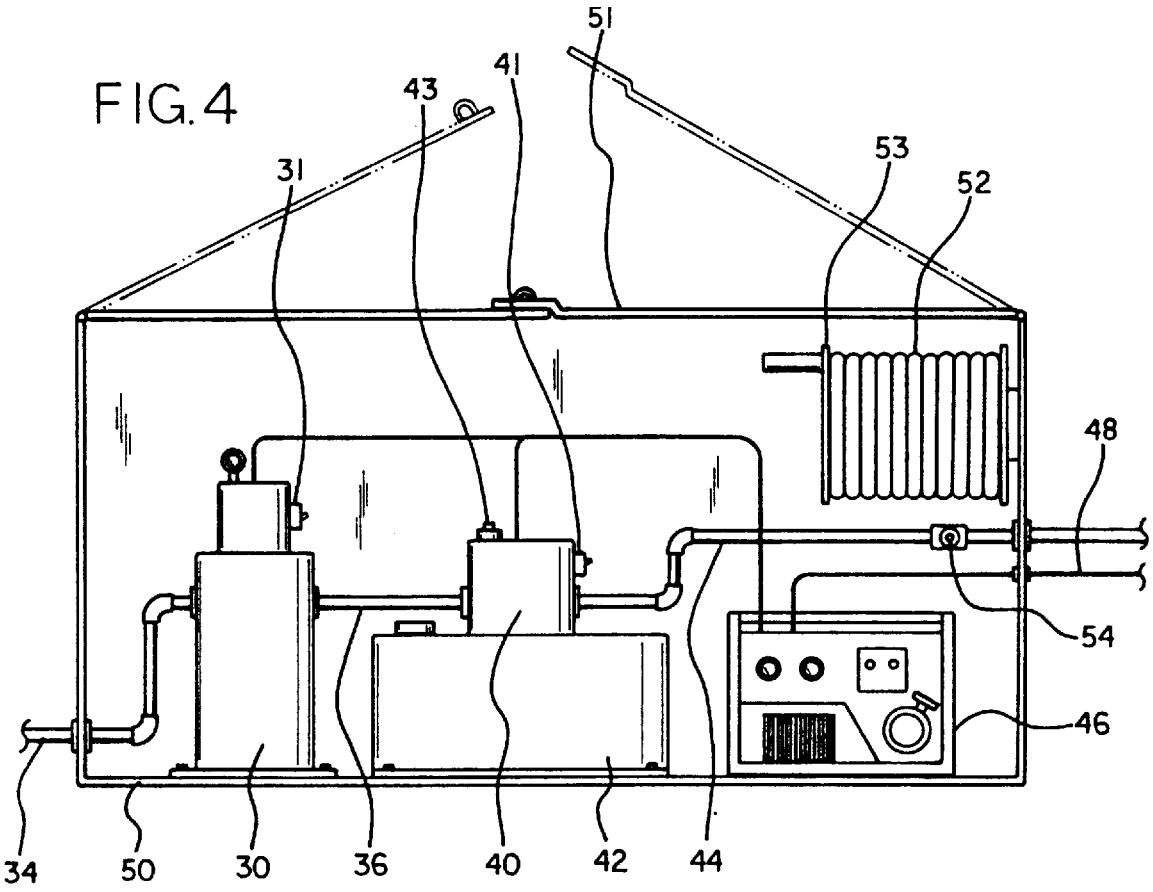
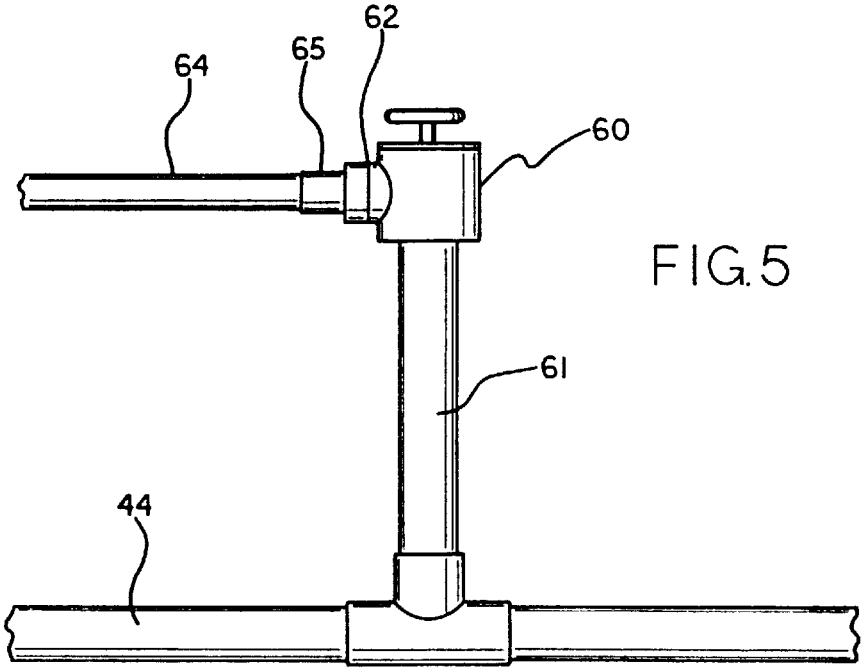
FIG. 5

EMERGENCY WATER RESERVOIR APPARATUS

BACKGROUND OF THE INVENTION

1. Field of the Invention

The present invention relates to fluid reservoir systems and more particularly pertains to a new Emergency Water Reservoir Apparatus for providing a ready water reserve for extinguishing fires at a location such as a residence.

2. Description of the Prior Art

The use of fluid reservoir systems is known in the prior art. More specifically, fluid reservoir systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art fluid reservoir systems include U.S. Pat. No. 3,977,474; U.S. Pat. No. 5,234,286; U.S. Pat. No. 4,978,249; U.S. Pat. No. 4,612,951; U.S. Patent Des. 336, 327; and U.S. Patent Des 305,353.

While these devices fulfill their respective, particular objectives and requirements, the aforementioned patents do not disclose a new Emergency Water Reservoir Apparatus. The inventive device includes a water storage tank having an interior reservoir in fluid communication with a water hydrant valve. A water intake conduit in fluid communication with an established water supply and the interior reservoir permits delivery of water into the water tank from the established water supply system. Included at the reservoir end of the water intake conduit is a water intake cut-off means and an anti-siphon valve means. A water pump means pumps water from the interior reservoir to the water hydrant valve. An infusion pump means with an infusion reservoir member and an adjustable infusion dispensing means provides infusion chemicals into the water passing from the interior reservoir to the water hydrant valve. An electrical power generator is included to provide backup power to the water pump means and the infusion pump means when the location's power supply is cut off. The water hydrant valve has a hose quick fitting means to allow water hoses to be quickly attached to it. The water hoses allow a user to direct water from the water hydrant valve to locations where it is needed.

In these respects, the Emergency Water Reservoir Apparatus according to the present invention substantially departs from the conventional concepts and designs of the prior art, and in so doing provides an apparatus primarily developed for the purpose of providing a ready water reserve for extinguishing fires at a location such as a residence.

SUMMARY OF THE INVENTION

In view of the foregoing disadvantages inherent in the known types of fluid reservoir systems now present in the prior art, the present invention provides a new Emergency Water Reservoir Apparatus construction wherein the same can be utilized for providing a ready water reserve for extinguishing fires at a location such as a residence.

The general purpose of the present invention, which will be described subsequently in greater detail, is to provide a new Emergency Water Reservoir Apparatus apparatus and method which has many of the advantages of the fluid reservoir systems mentioned heretofore and many novel features that result in a new Emergency Water Reservoir Apparatus which is not anticipated, rendered obvious, suggested, or even implied by any of the prior art fluid reservoir systems, either alone or in any combination thereof.

To attain this, the present invention generally comprises a water storage tank having an interior reservoir in fluid communication with a water hydrant valve. A water intake conduit in fluid communication with an established water supply and the interior reservoir permits delivery of water into the water tank from the established water supply system. Included at the reservoir end of the water intake conduit is a water intake cut-off means and an anti-siphon valve means. A water pump means pumps water from the interior reservoir to the water hydrant valve. An infusion pump means with an infusion reservoir member and an adjustable infusion dispensing means provides infusion chemicals into the water passing from the interior reservoir to the water hydrant valve. An electrical power generator is included to provide backup power to the water pump means and the infusion pump means when the location's power supply is cut off. The water hydrant valve has a hose quick fitting means to allow water hoses to be quickly attached to it. The water hoses allow a user to direct water from the water hydrant valve to locations where it is needed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Emergency Water Reservoir Apparatus apparatus and method which has many of the advantages of the fluid reservoir systems mentioned heretofore and many novel features that result in a new Emergency Water Reservoir Apparatus which is not anticipated, rendered obvious, suggested, or even implied by any of the prior art fluid reservoir systems, either alone or in any combination thereof.

It is another object of the present invention to provide a new Emergency Water Reservoir Apparatus which may be easily and efficiently manufactured and marketed.

It is a further object of the present invention to provide a new Emergency Water Reservoir Apparatus which is of a durable and reliable construction.

An even further object of the present invention is to provide a new Emergency Water Reservoir Apparatus which is susceptible of a low cost of manufacture with regard to both materials and labor, and which accordingly is then susceptible of low prices of sale to the consuming public, thereby making such Emergency Water Reservoir Apparatus economically available to the buying public.

Still yet another object of the present invention is to provide a new Emergency Water Reservoir Apparatus which provides in the apparatuses and methods of the prior art some of the advantages thereof, while simultaneously overcoming some of the disadvantages normally associated therewith.

Still another object of the present invention is to provide a new Emergency Water Reservoir Apparatus for providing a ready water reserve for extinguishing fires at a location such as a residence.

Yet another object of the present invention is to provide a new Emergency Water Reservoir Apparatus which includes a water storage tank having an interior reservoir in fluid communication with a water hydrant valve. A water intake conduit in fluid communication with an established water supply and the interior reservoir permits delivery of water into the water tank from the established water supply system. Included at the reservoir end of the water intake conduit is a water intake cut-off means and an anti-siphon valve means. A water pump means pumps water from the interior reservoir to the water hydrant valve. An infusion pump means with an infusion reservoir member and an adjustable infusion dispensing means provides infusion chemicals into the water passing from the interior reservoir to the water hydrant valve. An electrical power generator is included to provide backup power to the water pump means and the infusion pump means when the location's power supply is cut off. The water hydrant valve has a hose quick fitting means to allow water hoses to be quickly attached to it. The water hoses allow a user to direct water from the water hydrant valve to locations where it is needed.

Still yet another object of the present invention is to provide a new Emergency Water Reservoir Apparatus that would allow a home owner to protect his residence from the ravage of fire by having a ready reserve of water stored with the capability of extinguishing it.

Even still another object of the present invention is to provide a new Emergency Water Reservoir Apparatus that includes a means to introduce and mix fire retardant chemicals into the water to aid the extinguishing of various types of fires.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a partial sectional view thereof.

FIG. 3 is a partial sectional view illustration of the present invention.

FIG. 4 is a sectional view of the invention.

FIG. 5 is a side view of the invention.

DESCRIPTION OF THE PREFERRED EMBODIMENT

Figure 1:
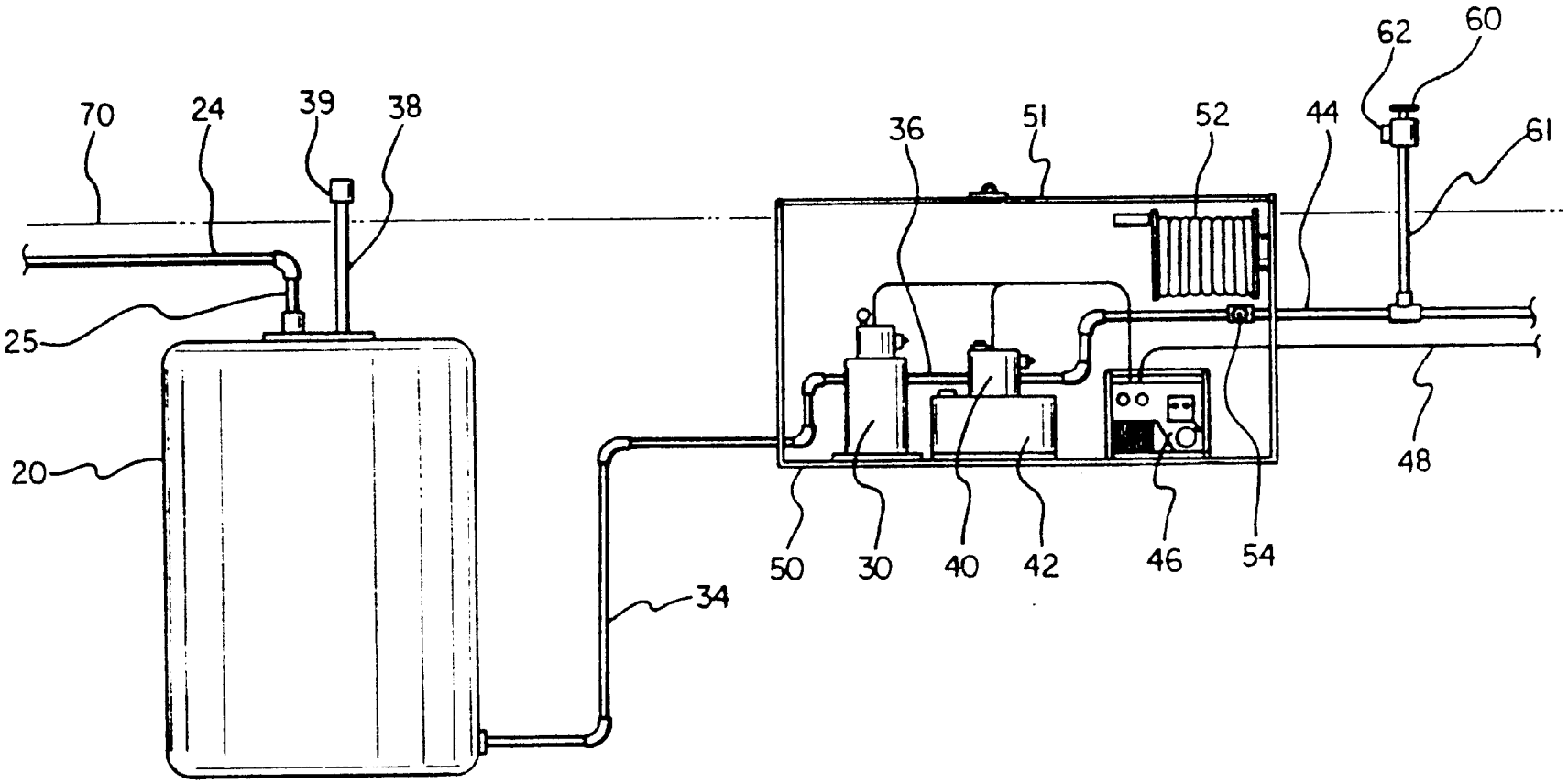
FIG. 1 is a side view of a new Emergency Water Reservoir Apparatus according to the present invention.

With reference now to the drawings, and in particular to FIGS. 1 through 5 thereof, a new Emergency Water Reservoir Apparatus embodying the principles and concepts of the present invention and generally designated by the reference numeral 10 will be described.

More specifically, it will be noted that the Emergency Water Reservoir Apparatus 10 comprises a water storage tank 20 having an interior reservoir 22, a water pump means 30, an infusion pump means 40, an electrical power generator 46, and a water hydrant valve 60.

As best illustrated in FIGS. 1 through 5, it can be shown that there is a water storage tank 20 of generally cylindrical configuration. The water storage tank 20 defines an interior reservoir 22 that is capable of holding a volume water. The water storage tank 20 may be of any size although it is recommended that the interior reservoir 22 can hold at least 3000 gallons of water. It is also recommended that the water storage tank 20 be opaque or translucent to help prevent algae growth within it. The water storage tank 20 may also be located below ground level 70.

The water intake conduit 24 connects the Emergency Water Reservoir Apparatus 10 to the location's established water supply system and delivers water 72 into the tank internal reservoir 22. The water intake conduit 24 may be located bellow ground level 70. The reservoir end 25 of the water intake conduit 24 is connected to the water storage tank 20 and is in fluid communication with the interior reservoir 22. Preferably, the water spout 27 of the reservoir end 25 should extend into the interior reservoir 22 from the top side of the water storage tank 20.

The reservoir end 25 of the water intake conduit 24 has a water intake cut-off means 28 having a cut-off float switch 29 which stops water from entering the water storage tank 20 once the interior reservoir 22 is filled. The water intake cut-off means 28 shuts off the reservoir end 25 once the water 72 within the tank internal reservoir 22 has reached a certain level to cause the cut-off float switch 29 to rise to a point that it causes the water intake cut-off means 28 to shut off the reservoir end 25.

An anti-siphon valve means 26 is also included at the reservoir end 25 of the water intake conduit 24. The anti-siphon valve means 26 prevents water 72 within the water storage tank 20 from being drained back into the established water supply system due to reduced or negative pressure within the water supply system.

A venting conduit 38 extends from the top of the water storage tank 20 to above ground level 70 providing a vent for the interior reservoir 22. A vent cap 39 prevents debris from entering the venting conduit 38 while allowing the above ground end of the venting conduit 38 to remain open.

A water pump means 30 is in fluid communication with the interior reservoir 22 of the water storage tank 20 by means of a conduit 34. The water pump means 30 pumps water from the interior reservoir 22 through the rest of the Emergency Water Reservoir Apparatus 10 system. The water pump means 30 may include a water pump activation switch 31 to allow a user to manually turn the water pump means 30 on or off. The tank end 35 of the conduit 34 extends into the bottom portion of the water storage tank 20 and is in fluid communication with the interior reservoir 22. A filter means 37 is disposed around the tank end 35 to prevent debris in the water 72 from being carried beyond the water storage tank 20.

An infusion pump means 40 is in fluid communication with the water pump means 30 by means of a conduit 36 between the infusion pump means 40 and the water pump means 30. The infusion pump means 30 allows the mixing of infusing chemicals such as fire retardant or wetting chemicals into the water flowing from the water pump means 30. The infusion pump means 40 includes a infusion reservoir member 42 that stores the infusion chemicals and has an adjustable infusion dispensing means 43 that allows a user to control the amount of infusion chemical being mixed with the water as desired. The infusion pump means 40 may also have an infusion pump activation switch means 41 that allows a user to manually turn the infusion pump means 40 on or off.

A water hydrant valve 60 located above ground level 70 and is connected to hydrant conduit 61 that extends from the water hydrant valve 60 to the main hydrant conduit 44. The main hydrant conduit 44 extends from the infusion pump means 40 to deliver water to the water hydrant valve 60 from the infusion pump means 40. The main hydrant conduit 44 may be extended to allow multiple spaced apart water hydrant valves 60 to be connected to it.

A water cut-off valve 54 is located within the main hydrant conduit 44 and is positioned in the pump system housing 50. The water cut-off valve 54 allows the main hydrant conduit 44 to be blocked for repairs or servicing.

The water hydrant valve 60 includes a hose quick fitting means 62. The hose quick fitting means 62 allows the quick fitting means end 65 of a water hose 64 to be quickly attached to the water hydrant valve 60 and in fluid communication with the water hydrant valve 60 so that water may pass from the water hydrant valve 60 through the water hose 64.

While all of the conduit may be made of any suitable material for making conduit it is recommended that all above ground level 70 conduit be made of metal and all below ground level 70 conduit be made of a plastic such as polyvinyl chloride (PVC).

The water pump means 30 and the infusion pump means 40 are generally powered by the location's electrical service. The water pump means 30 and the infusion pump means 40 are electrically coupled to the electrical service by electrical conduit 48. An electrical power generator 46 is electrically coupled to the water pump means 30 and the infusion pump 40 between the electrical service and the pumps. The electrical power generator 46 provides electrical power to the water pump means and the infusion pump means 40 in situations where the electrical service fails. The electrical power generator 46 may also be designed so that it automatically provides electrical power when the electrical service is cut off.

The water pump means 30, the infusion pump means 40, the electrical power generator 46, and the water cut off valve 54 are all contained within a pump system housing 50 that may be located below ground level 70. A pair of access panels 51 allows access to the interior of the pump system housing 50. A water hose storage apparatus 53 is also contained in the pump system housing 50 to allow a water hose 52 to be stored in the pump system housing 50.

In use, water is delivered to the interior reservoir 22 from the location's water supply system through the water intake conduit 24. When the interior reservoir 22 is filled, the cut-off float switch 29 rises to activate the water intake cut-off means 28 which shuts off the reservoir end 25 of the water intake conduit 24. This shuts off water entering the interior reservoir 22 until its water level is lowered.

The water pump means 30 draws water 72 from the interior reservoir 22 and pumps it to the water hydrant valve 60. The water passes through the infusion pump means 40 which adds infusion chemicals from the infusion reservoir member 42. When the water hydrant valve 60 is opened, water passes from the infusion pump means 40 to the water hydrant valve 60 through the main hydrant conduit 44. The water then may be directed from the water hydrant valve 60 to places it is needed by the water hose 64 attached to the water hydrant valve 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An emergency water reservoir apparatus for supplying water and infusion chemicals to extinguish fires, said emergency water reservoir apparatus comprising:

a subterranean water storage tank having an interior reservoir, said storage tank having an outlet conduit extending from said interior reservoir, a first end of said outlet conduit being in fluid communication with said interior reservoir;

a water hydrant valve having a hose quick fitting means for removably attaching a water hose thereto, said water hydrant valve being coupled to a second end of said outlet conduit, said water hydrant valve being in fluid communication with said outlet conduit;

a water intake conduit having a reservoir end, said intake conduit being in fluid communication with an established water supply, said reservoir end being in fluid communication with said interior reservoir to permit delivery of water to said interior reservoir from an established water supply system;

a substantially subterranean housing having a medial portion of said outlet conduit passing through an interior thereof and further exiting a side wall thereof;

a pair of access panels forming a top of said housing, each of said access panels being hingedly coupled to opposite ends of said housing for providing access to the interior of said housing;

wherein said water hydrant valve includes a vertical portion extending upwardly from said outlet conduit exterior of said housing such that said water hydrant valve is elevated with respect to said access panels of said housing and laterally spaced therefrom;

a water hose storage apparatus positioned in the interior of said housing adjacent the top of said housing, said water hose storage apparatus being mounted on said side wall of said housing adjacent to the top of said housing for allowing said water hose to be stored thereon about a horizontal axis;

a water intake cut-off means being included within said reservoir end, said water intake cut-off means being for preventing water from entering said interior reservoir from said water intake conduit when water in said interior reservoir reaches a certain volume;

an anti-siphon valve means being included within said reservoir end, said anti-siphon valve means being for preventing water within said interior reservoir from draining back into said water intake conduit;

a venting conduit being extended from said water tank, said venting conduit providing a vent to said interior reservoir;

a water pump means positioned in an interior of said housing, said water pump means being in fluid communication with said outlet conduit between said interior reservoir and said water hydrant valve, said water pump means being for pumping water from said interior reservoir to said water hydrant valve;

an infusion pump means positioned in the interior of said housing, said infusion pump means having an infusion reservoir member and an adjustable infusion dispensing means, said infusion pump means being in fluid communication with said outlet conduit between said water hydrant valve and said water pump means, said infusion reservoir member providing infusion chemicals to said infusion pump means, said infusion pump means being for providing infusion chemicals into water passing through said outlet conduit from said interior reservoir to said water hydrant valve, said adjustable infusion dispensing means being for allowing a user to adjust the amount of infusion chemicals said infusion pump means provides into water passing through said outlet conduit to said water hydrant valve;

a water cut-off valve positioned in the interior of said housing, the water cut-off valve being in fluid communication with said outlet conduit between said infusion pump means and said water hydrant valve, said water cut-off valve providing a cut-off float switch to close fluid communication between said interior reservoir and said water hydrant valve;

an electrical power generator positioned in the interior of said housing, said electrical power generator being electrically coupled to said water pump means and being electrically coupled to said infusion pump means, said electrical power generator providing power to said water pump means and to said infusion pump means; and wherein the water hose includes a quick fitting means positioned at one end, said one end being in fluid communication with said water hydrant valve, said quick fitting means being for removably attaching said one end of said water hose to said hose quick fitting means of said water hydrant valve.

* * * * *